US008484850B2

(12) United States Patent
Morisugi et al.

(10) Patent No.: US 8,484,850 B2
(45) **Date of Patent: *Jul. 16, 2013**

(54) HAIR REMOVER

(75) Inventors: Kazuhiro Morisugi, Inukami (JP); Toshio Ikuta, Hikone (JP)

(73) Assignee: Panasonic Corporation, Osaka (JP)

( * ) Notice: Subject to any disclaimer, the term of this patent is extended or adjusted under 35 U.S.C. 154(b) by 376 days.

This patent is subject to a terminal disclaimer.

(21) Appl. No.: 12/888,601

(22) Filed: Sep. 23, 2010

(65) Prior Publication Data

US 2011/0072669 A1 Mar. 31, 2011

(30) Foreign Application Priority Data

Sep. 25, 2009 (JP) ..... 2009-220454

(51) Int. Cl.
*B26B 19/14* (2006.01)
*A45D 26/00* (2006.01)

(52) U.S. Cl.
USPC ..... 30/29.5

(58) Field of Classification Search
USPC ..... 30/29.5, 43.6, 346.51
See application file for complete search history.

(56) References Cited

U.S. PATENT DOCUMENTS

| | | | | |
|---|---|---|---|---|
| 2,592,198 | A * | 4/1952 | Seeley et al. | 30/43.5 |
| 3,054,179 | A * | 9/1962 | Reiser et al. | 30/29.5 |
| 3,085,328 | A * | 4/1963 | Strike | 30/29.5 |
| 6,067,714 | A | 5/2000 | Taylor et al. | |
| 7,152,323 | B1 * | 12/2006 | Lin | 30/29.5 |
| 7,401,406 | B2 * | 7/2008 | Morisugi et al. | 30/29.5 |
| 7,874,073 | B2 * | 1/2011 | Ogawa et al. | 30/29.5 |
| 2005/0028369 | A1 | 2/2005 | Cocchiarella et al. | |
| 2006/0200991 | A1 * | 9/2006 | Chan | 30/29.5 |
| 2011/0232096 | A1 * | 9/2011 | Yabuuchi et al. | 30/29.5 |

FOREIGN PATENT DOCUMENTS

| | | | |
|---|---|---|---|
| CN | 201056002 | | 7/2008 |
| EP | 1749622 | A2 | 2/2007 |
| JP | 61-164608 | U | 3/1985 |
| JP | 62-159802 | U | 3/1986 |
| JP | 07-313241 | | 12/1995 |
| JP | 2001-120341 | | 5/2001 |
| JP | 2006-239289 | A | 9/2006 |
| JP | 2007-29382 | * | 2/2007 |
| JP | 3161441 | * | 7/2010 |

OTHER PUBLICATIONS

English translation of a Summary of Office Action for JP 2009-220454 dated Nov. 1, 2011(JP2009-220454 corresponds to this application U.S. Appl. No. 12/888,601).
Office Action from corresponding Chinese application No. 201010297905.1 dated Sep. 11, 2012, pp. 1-7.

* cited by examiner

*Primary Examiner* — Hwei C Payer
(74) *Attorney, Agent, or Firm* — Wolf, Greenfield & Sacks, P.C.; Randy J. Pritzker

(57) ABSTRACT

A hair remover including an outer blade and an inner blade accommodated in the outer blade. The outer blade includes a cylindrical side wall, an upper wall, and a bend connecting the side wall and the upper wall. Straight upper cutting edges and side cutting edges are formed by slits extending from the upper wall to an upper part of the side wall. The inner blade includes a straight upper cutting edge, which is formed at a location corresponding to the upper cutting edges of the upper blade, and a straight side cutting edge, which is formed at a location corresponding to the side cutting edges of the outer blade. The outer blade and the inner blade are formed so as to clip body hair through cooperation between the straight side cutting edges and cooperation between the straight upper cutting edges.

8 Claims, 8 Drawing Sheets

HAIR REMOVER

CROSS-REFERENCE TO RELATED APPLICATIONS

This application is based upon and claims the benefit of priority from prior Japanese Patent Application No. 2009-220454, filed on Sep. 25, 2009, the entire contents of which are incorporated herein by reference.

BACKGROUND OF THE INVENTION

The present invention relates to a hair remover for trimming body hair such as nose hair.

Japanese Laid-Open Patent Publication No. 7-313241 describes a prior art example of a nose hair trimmer. The nose hair trimmer includes an outer blade, which is cylindrical and suitable for insertion into a nostril, and an inner blade, which is accommodated in the outer blade. The inner blade is driven and rotated by a drive source. The nose hair trimmer clips nose hair between the stationary outer blade and the rotating inner blade. In the nose hair trimmer of the prior art, the outer blade includes a plurality of teeth, which are bent so as to be curved. Each tooth has a curved outer blade cutting edge formed on each of its two lateral sides. The inner blade includes an inner blade cutting edge, which is curved in conformance with the outer blade cutting edges. Rotation of the inner blade slides the inner blade cutting edge along the outer blade cutting edges. This clips the user's nose hair, which are received in slits of the outer blade, between the cutting edges of the outer blade and the inner blade.

It is desirable for the nose hair trimmer to have a high clipping capability. To improve the clipping capability, the number of cutting edges in the outer blade and the inner blade may be increased. However, when each blade has more cutting edges, this tends to increase noise during use of the nose hair trimmer.

For example, in the nose hair trimmer of the prior art, the outer blade and the inner blade each have an upper portion that is bent so as to be curved. However, it is difficult for the bent shape (curved shape) of the top portions to be in conformance between the outer blade and the inner blade. This may increase interference between the outer blade and the inner blade and thereby increase noise. Further, due to the difficulty for conformance in the curved shapes of the outer blade and the inner blade, there may be locations at which the pressure applied by the inner blade to the outer blade is insufficient. At such locations, nose hair may not be clipped in a satisfactory manner.

SUMMARY OF THE INVENTION

It is an object of the present invention to provide a hair remover that is quiet and has an increased clipping capacity.

One aspect of the present invention is a hair remover including an outer blade, a drive source, and an inner blade accommodated in the outer blade. The inner blade is rotatable by the drive source to clip body hair in cooperation with the outer blade. The outer blade includes a cylindrical side wall, an upper wall, a bend connecting the side wall and the upper wall, and straight upper cutting edges and straight side cutting edges formed by a plurality of slits extending from the upper wall to an upper part of the side wall. The inner blade includes a straight upper cutting edge, which is formed at a location corresponding to the upper cutting edges of the upper blade, and a straight side cutting edge, which is formed at a location corresponding to the side cutting edges of the outer blade. The outer blade and the inner blade are formed so as to clip body hair through at least cooperation between the straight side cutting edges and cooperation between the straight upper cutting edges.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which:

FIG. 4(*b*) is an enlarged partial view of an inner blade shown in FIG. 4(*a*);

DETAILED DESCRIPTION OF THE INVENTION

A nose hair trimmer serving as a hair remover according to one embodiment of the present invention will now be discussed with reference to the drawings.

Figure 1:
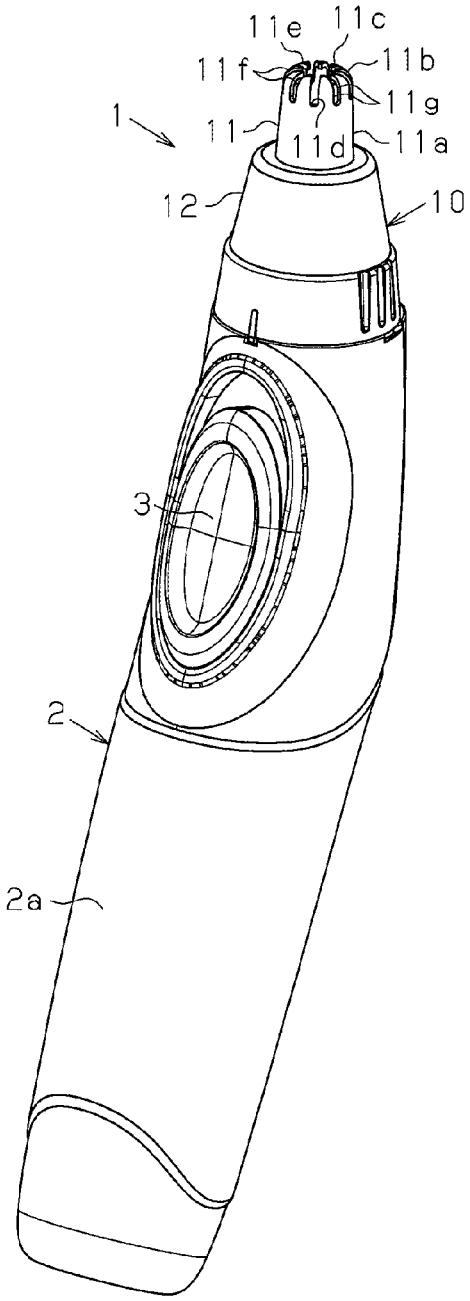
FIGS. 1(*a*) and 1(*b*) are perspective views showing a nose hair trimmer according to one embodiment of the present invention.
Figure 1:
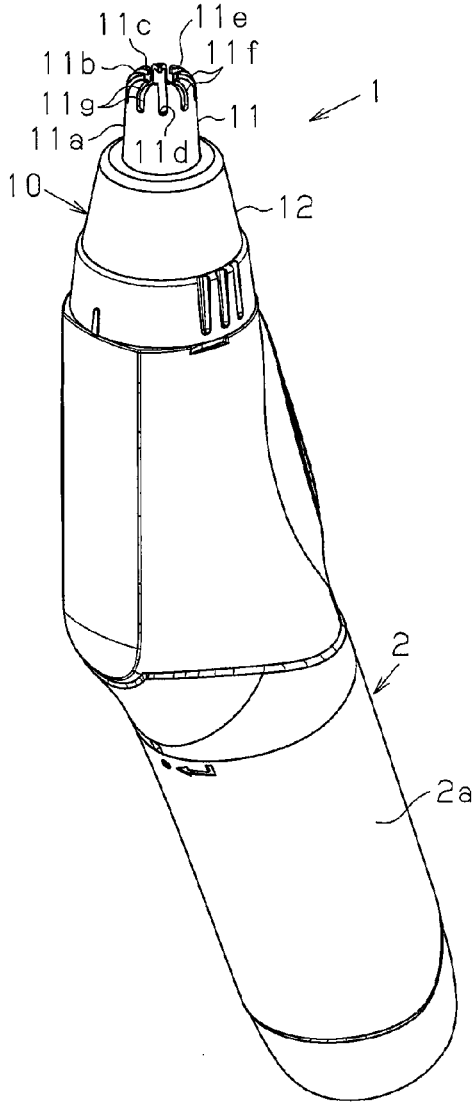

As shown in FIGS. 1(*a*) and 1(*b*), the nose hair trimmer includes a blade unit 1 and a main body 2, which is coupled to the bottom end of the blade unit 1. The main body 2 includes a handle 2*a* and a switch 3, which is arranged in the upper side of the handle 2*a* and operated by a user to activate and deactivate the nose hair trimmer. In the illustrated example, the nose hair trimmer is cylindrical but slightly bent. This shape allows for the user to easily insert the outer blade 11 into the nostril while holding the handle 2*a* upright.

Figure 2:
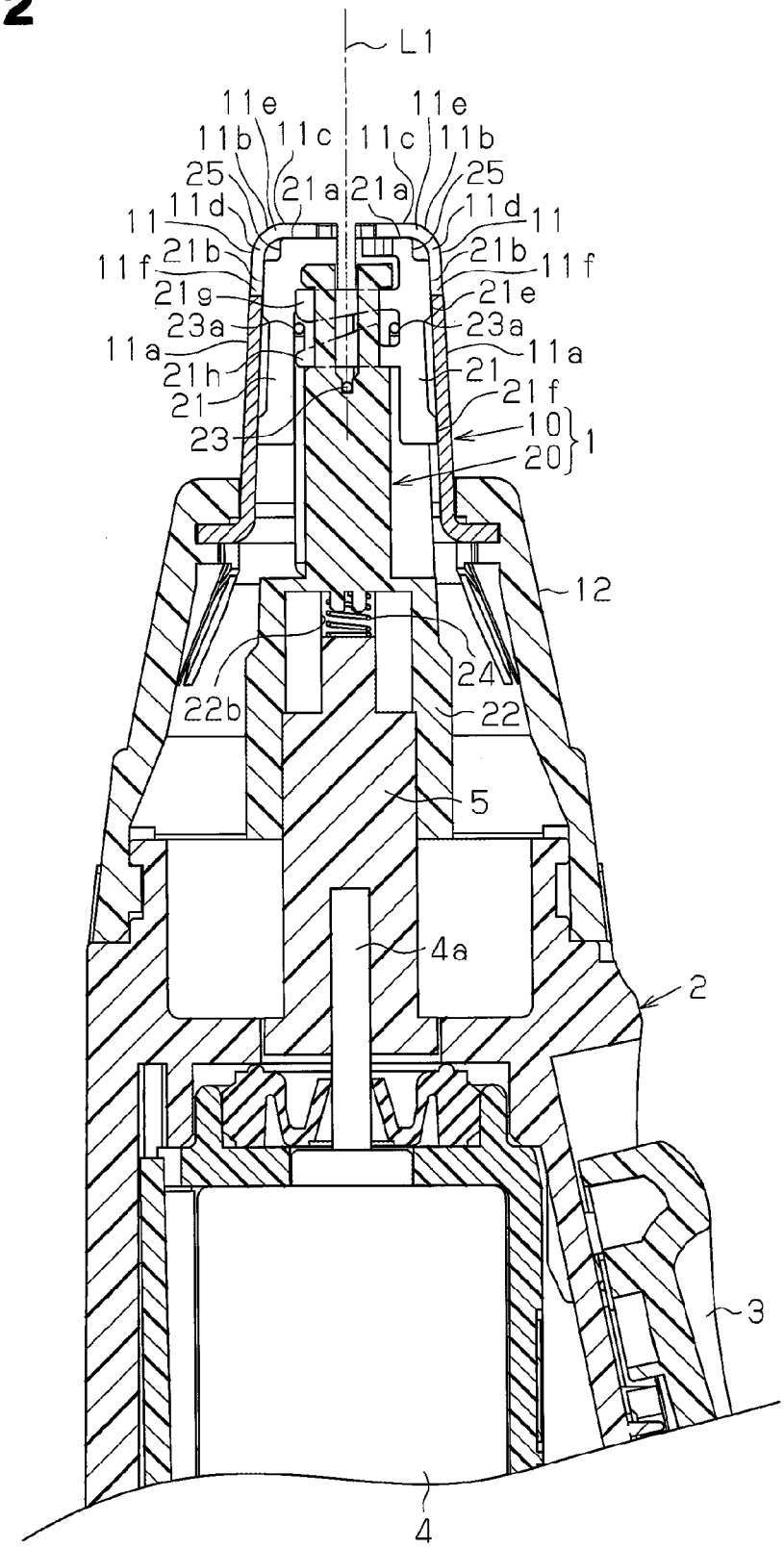
FIG. 2 is a cross-sectional view showing the nose hair trimmer of FIG. 1.

Referring to FIG. 2, a motor 4 serving as a drive source is accommodated in the main body 2. The motor 4 includes a motor shaft 4*a*, which is coupled by a joint 5 to an inner blade block 20. When the switch 3 is turned on, a battery (not shown), which is accommodated in the handle 2*a* at the lower part of the main body 2, drives the motor 4. When the motor 4 is driven, the motor shaft 4*a* and joint 5 rotate the inner blade block 20. In this manner, the blade unit 1 clips the user's nose hair (body hair).

Figure 3:
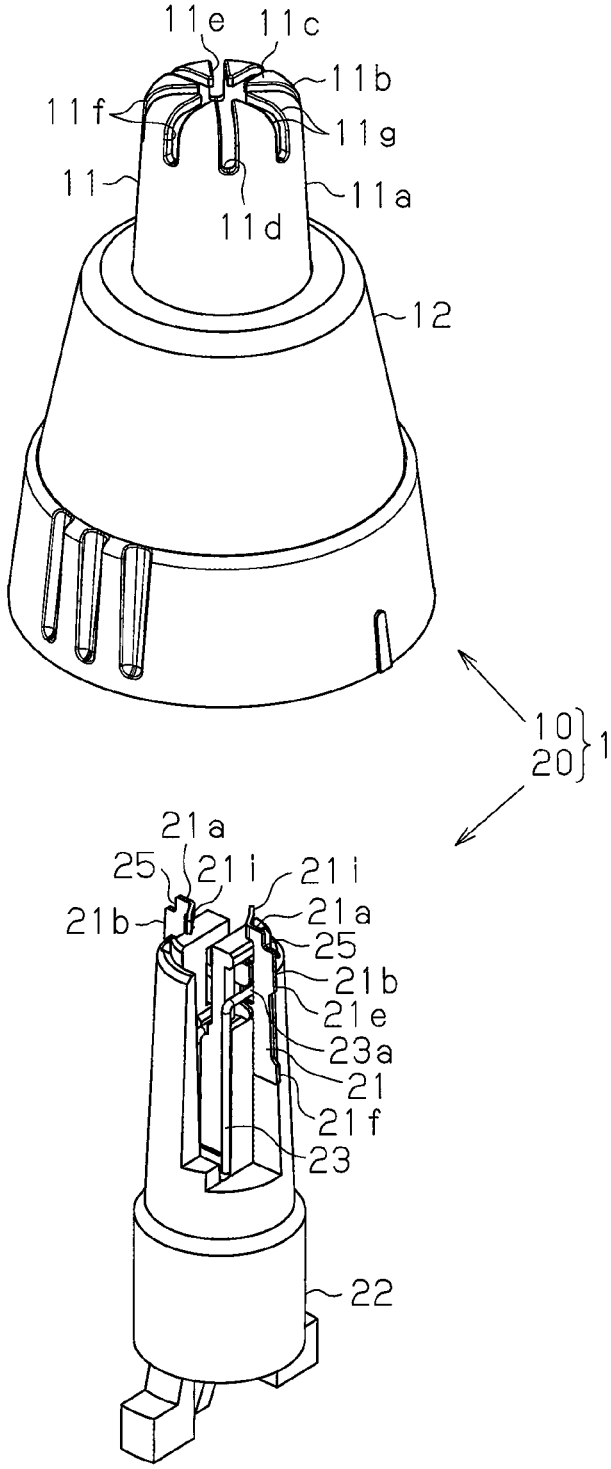
FIG. 3 is a perspective view showing an outer blade block and inner blade block of the nose hair trimmer of FIGS. 1(*a*) and 1(*b*)

As shown in FIG. 3, the blade unit 1 includes an outer blade block 10 and an inner blade block 20.

Figure 4A:
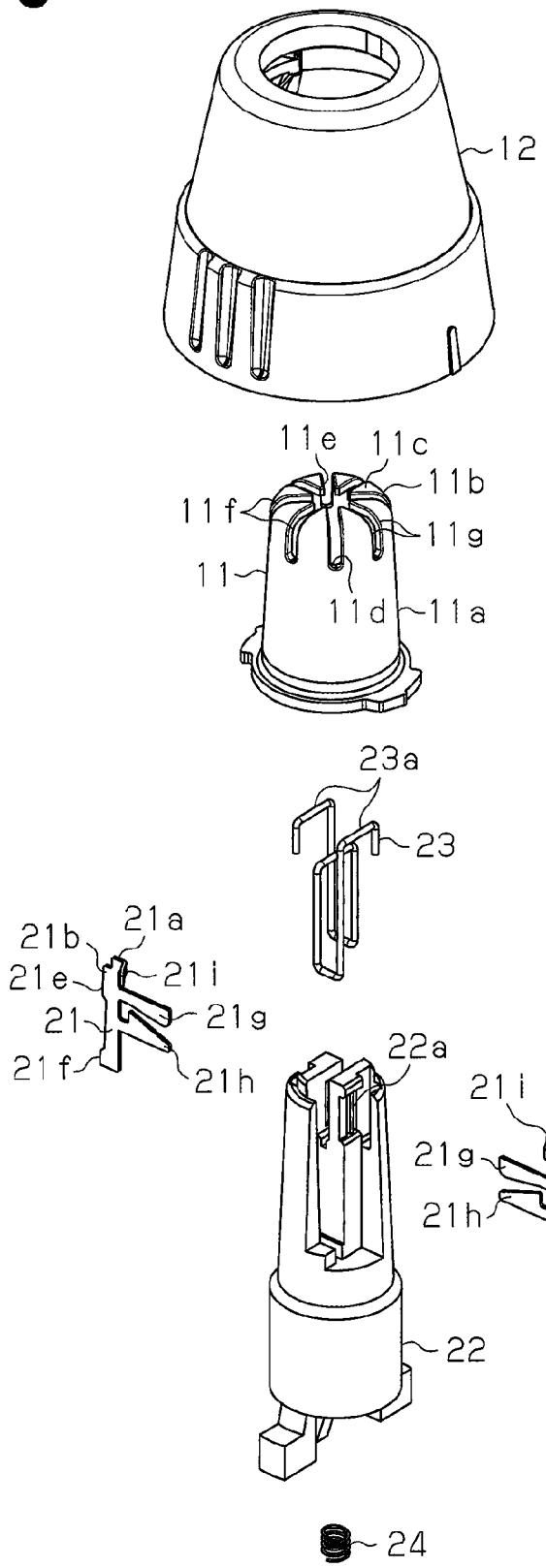
FIG. 4(*a*) is an exploded perspective view showing the outer and inner blade blocks of FIG. 3.
Figure 4B:
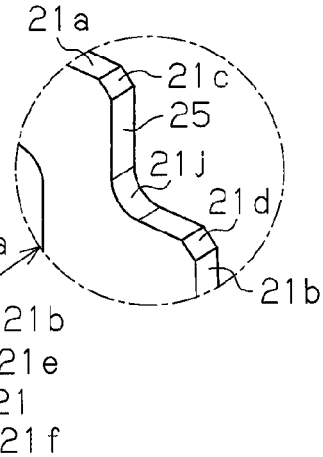
Figure 6:
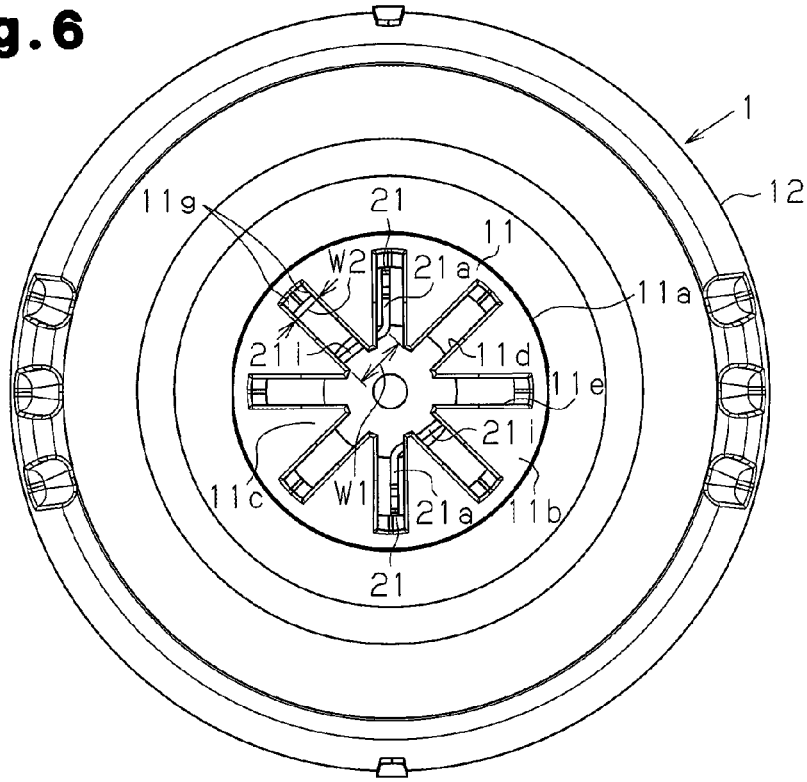
FIG. 6 is a plan view of the blade unit.

Referring to FIGS. 3 and 4, the outer blade block 10 includes an outer blade 11, which has a cylindrical side wall 11*a* and an upper wall 11*c*, and an outer blade frame 12, which is hollow and shaped as a truncated cone. In the outer blade 11, a curved bend 11*b* connects the side wall 11*a* and upper wall 11*c*. The upper part of the side wall 11*a* and the upper wall 11*c* are partially open by a plurality of slits 11*d* (refer to FIG. 6), which are extended in the radial direction and arranged at equal angular intervals. The outer blade frame 12 holds the basal end, or lower end, of the outer blade 11. The outer blade frame 12 mounts the outer blade block 10 onto the main body 2 in a removable manner. In the illustrated example, the upper wall 11*c* is circular and flat. Further, the term cylindrical includes tubular and tapered tubular shapes.

Figure 5:
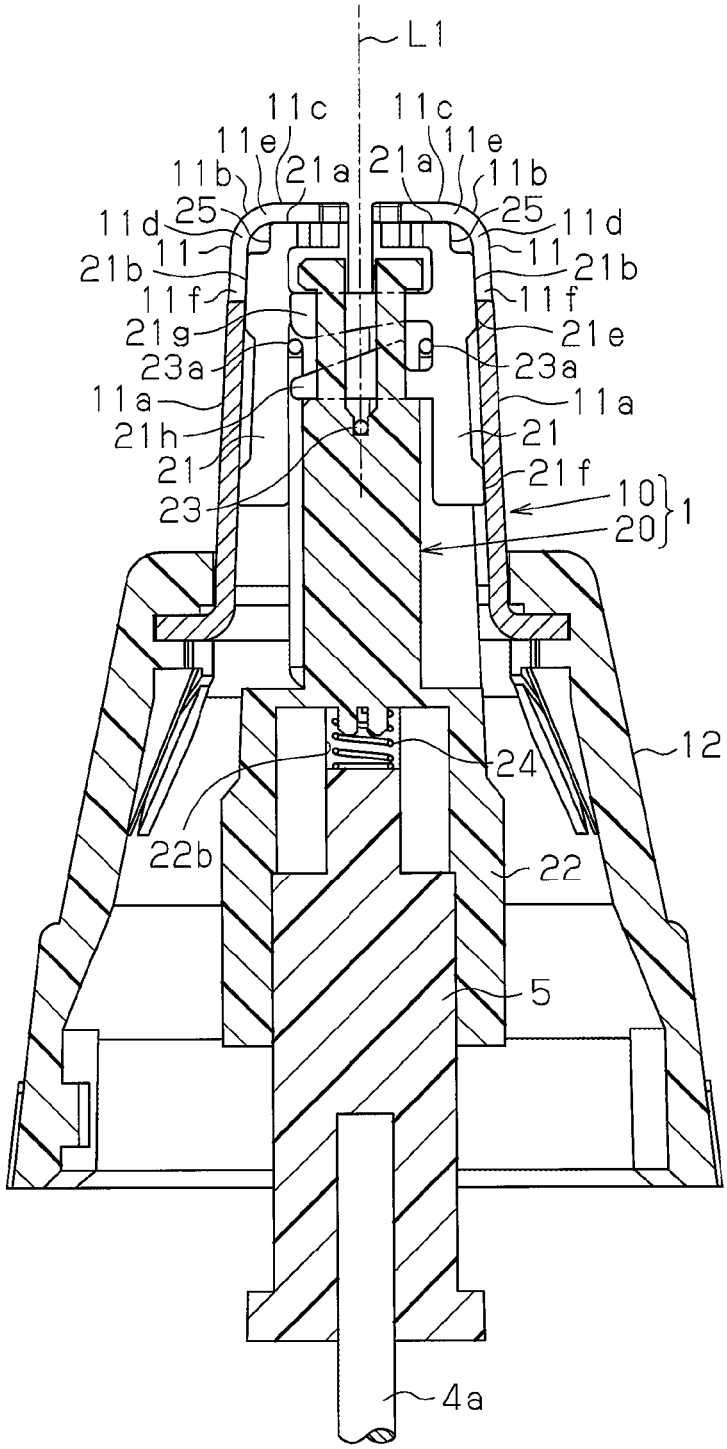
FIG. 5 is a cross-sectional view of a blade unit.

Outer blade cutting edges will now be described. As shown in FIG. 5, in the outer blade 11, the upper wall 11*c* includes upper cutting edges 11*e*, and the side wall 11*a* includes side cutting edges 11*f*. The bend 11*b* is located between the upper cutting edges 11*e* and the side cutting edges 11*f*. Each of the upper cutting edges 11*e* and side cutting edges 11*f* are straight. The outer blade cutting edges cooperate with inner blades 21, which will be described later, to clip nose hair that are received in the slits 11*d*. The upper cutting edges 11*e* extend straight and orthogonal to the rotation axis L1 of the inner blade block 20 (motor 4). This facilitates formation of the outer blade 11. As shown in FIGS. 3 and 4, the upper cutting edges 11*e* and side cutting edges 11*f* have outer rims 11*g* that are preferably chamfered. The chamfering allows for smooth insertion of the outer blade 11 into the nostril.

Figure 7:
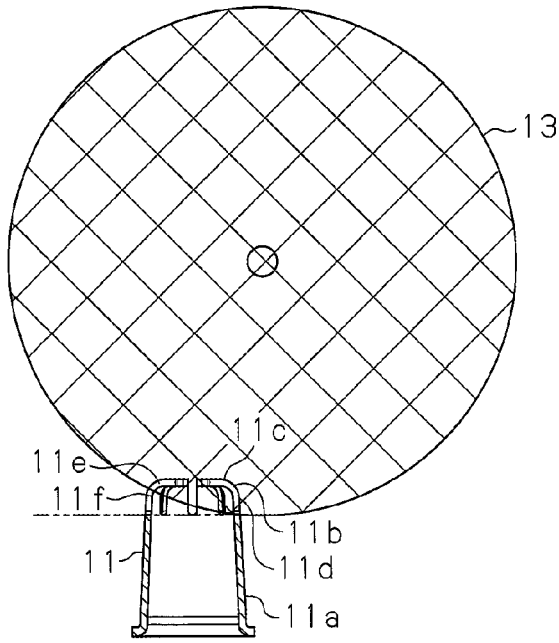
FIG. 7 is a schematic diagram illustrating a process for forming slits in the outer blade.

In the illustrated example, the outer blade 11 has eight slits 11*d*. When there are eight slits 11*d*, this ensures that the slits 11*d* have a width W2 that is suitable for receiving nose hair (refer to FIG. 6), while the outer blade 11 is held with its diameter remaining suitable for insertion into a user's nostril. Thus, nose hair is effectively clipped when there are eight slits 11*d*. In addition, as shown in FIG. 7, when the outer blade 11 has an even number of slits 11*d* arranged at equal angular intervals, a disk-shaped grindstone 13 may be moved past the center of the circular upper wall 11*c* of the outer blade 11, which is cylindrical. This allows for two slits 11*d* to be formed at the same time during a single passage of the grindstone 13 and thus shortens the formation time of the slits 11*d*.

The inner blade block 20 will now be described. Referring to FIGS. 3 to 5, the inner blade block 20 includes the inner blades 21, an inner blade frame 22, a sideward pushing spring 23, and an upward pushing spring 24. The sideward pushing spring 23 pushes the inner blades 21 against the side wall 11*a* of the outer blade 11. The upward pushing spring 24 pushes the inner blade 21 against the upper wall 11*c* of the outer blade 11. In the illustrated example, the two inner blades 21 of the inner blade block 20 have the same structure. There may be just one inner blade 21 or a plurality of inner blades 21. One of the inner blades 21 will now be described.

The inner blade 21 may be planar. The inner blade 21 includes a straight upper cutting edge 21*a*, which corresponds to the upper cutting edges 11*e* of the outer blade 11, and a straight side cutting edge 21*b*, which corresponds to the side cutting edges 11*f* of the outer blade 11. When the motor 4 drives and rotates the inner blade block 20, the upper cutting edges 11*e* of the outer blade 11 cooperate with the upper cutting edge 21*a* of the inner blade 21 and the side cutting edges 11*f* of the outer blade 11 cooperate with the side cutting edges 21*b* of the inner blade 21 to clip the nose hair received in the slits 11*d*. The straight cutting edges 11*e*, 11*f*, 21*a*, and 21*b* allow for the shapes of the outer blade 11 and the inner blade 21 to be in conformance more easily than when they are curved. This decreases interference between the outer blade 11 and the inner blade 21 that would be caused when the outer blade 11 and inner blade 21 are not shaped in conformance. Further, the production of noise is suppressed. In addition, the pressure applied by the inner blade 21 to the outer blade 11 becomes stable and allows for satisfactory clipping of nose hair. This improves the clipping capability.

The upper cutting edge 21*a* of the inner blade 21 extends straight and orthogonal to the rotation axis L1 of the inner blade block 20. Further, the straight upper cutting edge 21*a* facilitates formation of the inner blade 21 and simplifies contact of the inner blade 21 with the outer blade 11.

The inner blade 21 includes a tetragonal cutout portion, or relief 25, at a location corresponding to the bend 11*b* of the outer blade 11. Due to the relief 25 in the inner blade 21, the outer blade 11 and inner blade 21 contact each other only at straight portions and do not contact each other at curved portions. This effectively suppresses the production of noise and prevents incomplete clipping of the nose hair that may occur at curved portions.

As shown in FIG. 4(*b*), a corner 21*c*, which is formed between the relief 25 and the upper cutting edge 21*a*, and a corner 21*d*, which is formed between the relief 25 and the side cutting edge 21*b*, are both chamfered. When the inner blade 21 is inserted into the outer blade 11, the chamfered corners 21*c* and 21*d* prevent the side cutting edge 21*b* of the inner blade 21 from getting caught in the side wall 11*a* of the outer blade 11. This facilitates the insertion of the inner blade 21 into the outer blade 11. Dimensional errors in the inner blade 21 and outer blade 11 may cause the upper cutting edge 21*a* or side cutting edge 21*b* of the inner blade 21 to project relatively out of the curved bend 11*b* of the outer blade 11. Even in such a case, the chamfered corners 21*c* and 21*d* suppress interference between the bend 11*b* and the cutting edges 21*a* and 21*b* and minimize the influence of dimensional errors in the inner blade 21 and outer blade 11.

A corner 21*j* in the relief 25 is curved. This increases the strength of the corner 21*j* and prevents deformation and damage of the inner blade 21.

The inner blade 21 further includes side sliding portions 21*e* and 21*f* facing toward the side wall 11*a* of the outer blade 11. The side sliding portion 21*e* is continuous with the side cutting edge 21*b*, and the side sliding portion 21*f* is spaced apart by a predetermined distance from the side sliding portion 21*e*. In the illustrated example, each of the side sliding portions 21*e* and 21*f* are straight projections. The inner blade 21 includes an upper arm 21*g* and a lower arm 21*h*, which project in a direction opposite to the side cutting edge 21*b*. The upper arm 21*g* and the lower arm 21*h* are fitted into an inner blade fitting hole 22*a* formed in the inner blade frame 22. The sideward pushing spring 23, which is formed by a single wire spring, is mounted on the inner blade frame 22. The sideward pushing spring 23 has an abutment portion 23*a*, which abuts against the inner blade 21. The elastic force of the sideward pushing spring 23 pushes the inner blade 21 outward in the radial direction against the inner surface of the side wall 11*a* of the outer blade 11. Thus, as the inner blade 21 receives the elastic force of the sideward pushing spring 23, the two side sliding portions 21*e* and 21*f* slide along the inner surface of the outer blade 11. In this manner, the inner blade 21 stably slides along the side wall 11*a* of the outer blade 11 while preventing the side cutting edge 21*b* from projecting into the slits 11*d*.

The upper part of the inner blade 21 includes a bent piece 21*i*, which is inclined relative to the radial direction and bent in the circumferential direction. The bent piece 21*i* has a width W1, which is the distance between the circumferential positions of the radially basal and distal ends of the bent piece 21*i*. The width W1 is set to be greater than the width W2 of the slits 11*d* of the outer blade 11. In the illustrated example, the upward pushing spring 24, which is a coil spring, is accommodated in a lower cavity 22*b* (refer to FIG. 5) of the inner blade frame 22. Thus, the upward pushing spring 24 is arranged between the inner blade frame 22 and the joint 5. The elastic force of the upward pushing spring 24 pushes the inner blade 21 in the upper direction against the inner surface of the upper surface 11*c* of the outer blade 11. Thus, as the inner blade 21 receives the elastic force of the upward pushing spring 24, the bent piece 21*i* slides along the inner surface of the upper wall 11*c* of the outer blade 11. In this manner, the inner blade 21 slides along the upper wall 11*c* and the side wall 11*a* of the outer blade 11, while preventing the upper cutting edges 21*a* from projecting into the slits 11*d*.

In this manner, the outer blade block 10 and the inner blade block 20 form the blade unit 1 of the nose hair trimmer according to the present embodiment. This clips nose hair with the outer blade 11 and the inner blade 21 in a satisfactory manner.

The structures of the outer blade 11 and the inner blades 21 may be described in the following manner. The outer blade 11 includes a plurality of teeth formed by the slits 11*d*. Each tooth includes a basal portion, a distal portion, and a bent portion. The basal portion extends upward substantially parallel to the center axis of the outer blade 11 (e.g., rotation axis L1). The distal portion extends inward toward the center axis of the outer blade 11. The bent portion is curved and located between the basal portion and the distal portion. A straight edge, or the upper cutting edge 11*e*, is formed on the distal portion, and a straight edge, or the side cutting edge 11*f*, is formed on the basal portion. Each inner blade 21 includes the upper cutting edge 21*a*, the side cutting edge 21*b*, and the relief 25. The upper cutting edge 21*a* is a straight edge formed at a location corresponding to the upper cutting edge 11*e* of the outer blade 11. The side cutting edge 21*b* is a straight edge formed at a location corresponding to the side cutting edge 11*f* of the outer blade 11. The relief 25 is a cutout portion formed at a location corresponding to the bend 11*b* of the outer blade 11. The relief 25 of the inner blade 21 does not contact the outer blade 11. The inner blade 21 contacts the outer blade 11 only with its straight portions, which include the upper cutting edge 21*a* and the side cutting edge 21*b*. Thus, the inner blades 21 rotate smoothly and reduce noise, while improving the clipping capability.

The present embodiment has the advantages described below.

(1) In the present embodiment, the outer blade 11 includes the cylindrical side wall 11*a*, the upper wall 11*c*, and the curved bend 11*b*, which connects the side wall 11*a* and the upper wall 11*c*. The outer blade 11 includes the straight upper cutting edges 11*e* and side cutting edges 11*f* formed by the slits 11*d* extending from the upper wall 11*c* to the upper part of the side wall 11*a*. Each inner blade 21 includes the straight upper cutting edge 21*a*, which corresponds to the upper cutting edges 11*e* of the outer blade 11, and the straight side cutting edge 21*b*, which corresponds to the side cutting edges 11*f* of the outer blade 11. The outer blade 11 and the inner blade 21 clip nose hair with the straight side cutting edges 11*f* and 21*b* and the straight upper cutting edges 11*e* and 21*a*. In addition to the side cutting edges 11*f* and 21*b*, the nose hair trimmer includes the straight upper cutting edges 11*e* and 21*a*. The straight cutting edges 11*f*, 11*e*, 21*a*, and 21*b* allow for the shapes of the outer blade 11 and the inner blades 21 to be in conformance more easily than when they are curved. This decreases interference between the outer blade 11 and the inner blades 21 and suppresses the production of noise. Further, the pressure applied by the inner blades 21 to the outer blade 11 becomes stable and allows for satisfactory clipping of nose hair. This improves the clipping capability.

(2) In the present embodiment, in the outer blade 11 and the inner blades 21, each of the upper cutting edges 11*e* and 21*a* are formed to extend straight and orthogonal to the rotation axis L1 of the inner blades 21. This facilitates formation of the outer blade 11 and the inner blade 21 and simplifies contact of the inner blade 21 with the outer blade 11.

(3) The outer blade 11 includes the eight (even number) slits 11*d*, which are arranged at equal angular intervals. Thus, by moving the grindstone 13 past the center of the circular upper wall 11*c* of the outer blade 11, which is cylindrical, two slits 11*d* may be formed at the same time. When an odd number of slits 11*d* are provided, the slits 11*d* are formed one at a time. Thus, the even number of slits 11*d* allows for the slits 11*d* to be formed within a short period of time. In particular, when there are eight slits 11*d*, this ensures that the slits 11*d* have the width W2 that is suitable for receiving nose hair (refer to FIG. 6), while the outer blade 11 is held with its diameter remaining suitable for insertion into a user's nostril. Thus, nose hair is further effectively clipped when there are eight slits 11*d*.

(4) In the present embodiment, to prevent contact between the outer blade 11 and the inner blades 21 at curved portions, each inner blade 21 includes the relief 25, which is arranged at a location corresponding to the curved bend 11*b* of the outer blade 11. Due to the relief 25, the inner blades 21 and the outer blade 11 are in contact with each other only at straight portions and not at curved portions. This further effectively suppresses the production of noise.

(5) In the present embodiment, the relief 25 is a tetragonal cutout portion formed at a location corresponding to the curved bend 11*b* of the outer blade 11 in the inner blade 21. Thus, noise may be suppressed just by slightly changing the shape of the inner blade 21.

(6) In the present embodiment, each inner blade 21 includes the chamfered corner 21*c*, which is arranged between the relief 25 and the upper cutting edge 21*a*, and the chamfered corner 21*d*, which is arranged between the relief 25 and the side cutting edge 21*b*. Thus, when the inner blade 21 is inserted into the outer blade 11, the chamfered corners 21*c* and 21*d* prevent the side cutting edges 21*b* of the inner blades 21 from getting caught in the side wall 11*a* of the outer blade 11. This facilitates the insertion of the inner blade 21 into the outer blade 11. Further, even when dimensional errors in the inner blade 21 and outer blade 11 cause the upper cutting edges 21*a* or side cutting edges 21*b* of the inner blades 21 to project relatively out of the curved bend 11*b* of the outer blade 11, the chamfered corners 21*c* and 21*d* suppress interference between the bend 11*b* and the cutting edges 21*a* and 21*b* and minimize the influence of dimensional errors in the inner blade 21 and outer blade 11.

(7) In the present embodiment, the width W1 of the bent piece 21*i* formed on the upper part of each inner blade 21 is greater than the width W2 of the slits 11*d* of the outer blade 11. This prevents the upper cutting edges 21*a* of the inner blades 21 from projecting into the slits 11*d* and thereby prevents damaging of the inner blades 21 and the like. Further, the bent piece 21*i* may easily be formed by just bending part of the corresponding inner blade 21.

The present examples and embodiments are to be considered as illustrative and not restrictive, and the invention is not to be limited to the details given herein, but may be modified within the scope and equivalence of the appended claims.

Figure 8:
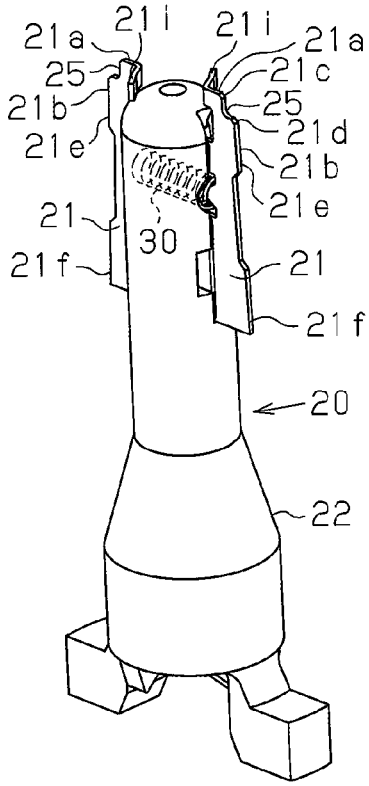
FIG. 8 is a perspective view showing a first modification of the inner blade block.

In the above-discussed embodiment, the sideward pushing spring 23, which is formed by a single wire spring, pushes the inner blades 21 against the side wall 11*a* of the outer blade 11. However, the means for urging the inner blades 21 is not limited to the sideward pushing spring 23. For example, as shown in FIG. 8, a typical coil spring 30 may be used to push the inner blades 21 against the side wall 11*a* of the outer blade 11.

Figure 9:
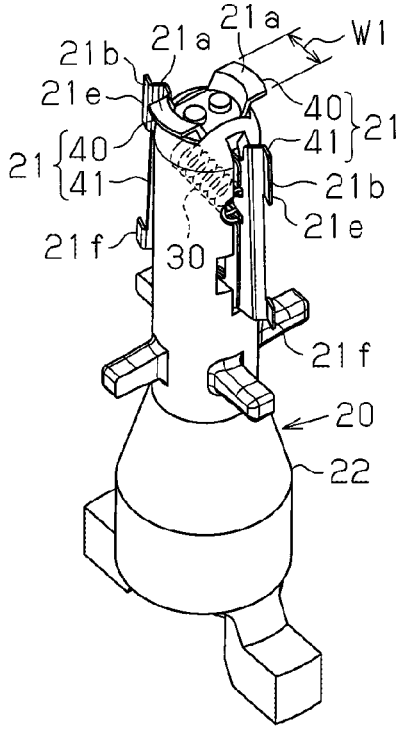
FIG. 9 is a perspective view showing a second modification of the inner blade block.
Figure 10A:
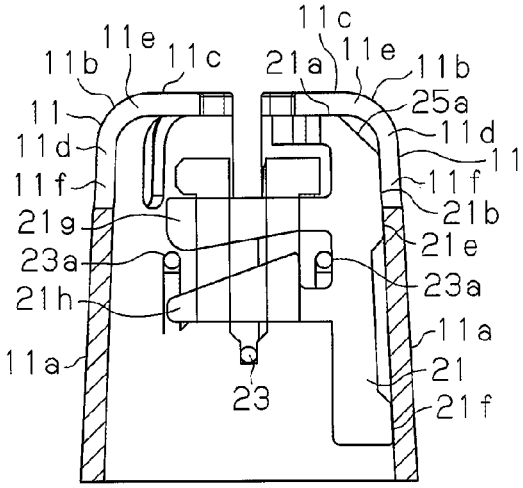
FIGS. 10(*a*) to 10(*d*) are cross-sectional diagrams showing reliefs in different modifications.
Figure 10B:
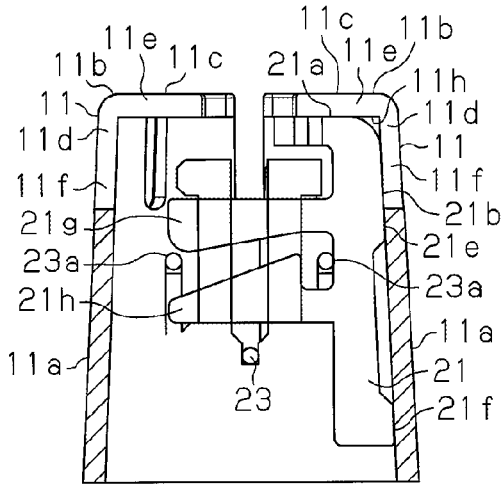
Figure 10C:
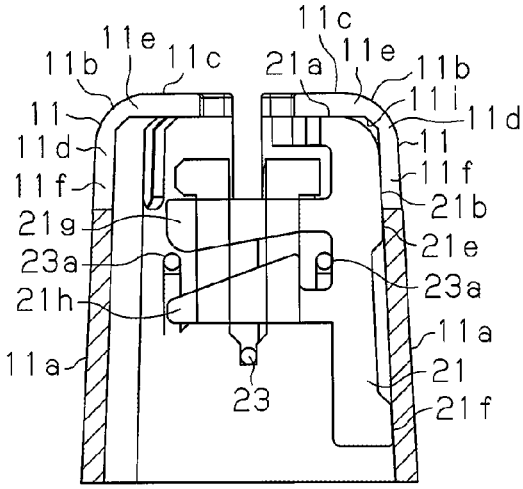
Figure 10D:
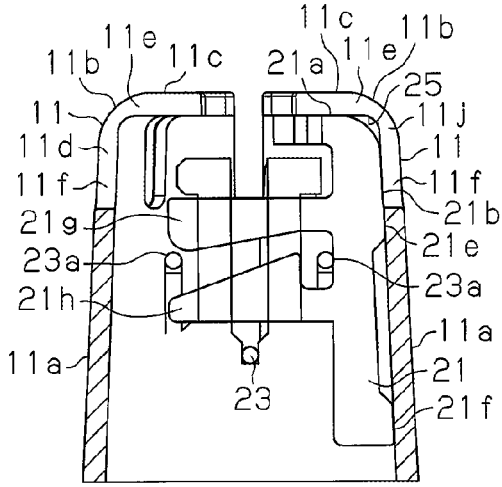

In the above-discussed embodiment, the upper cutting edge 21*a* and side cutting edge 21*b* are each formed integrally with the corresponding inner blade 21. Instead, for example, as shown in FIG. 9, each inner blade 21 may include an upper inner blade 40, which includes the upper cutting edge 21*a*, and a side inner blade 41, which includes the side cutting edge 21*b*. In this case, the upper cutting edge 21*a* and the side cutting edge 21*b* are formed by discrete bodies. Thus, in comparison to when the upper cutting edge 21*a* and the side cutting edge 21*b* are formed integrally with the corresponding inner blade 21, the influence of differences in the dimensions and shapes of the upper cutting edges 21*a* and the side cutting edges 21*b* is minimized. As a result, the inner blades 21 slide in a preferable manner along the outer blade 11. Further, in this structure, the width W1 of the upper part (upper cutting edge 21*a*) of the inner blade 21 is greater than the width W2 of the slits 11*d* in the outer blade 11. This prevents the upper cutting edges 21*a* of the inner blades 21 from projecting into the slits 11*d* of the outer blade 11 and thereby prevents damaging of the inner blades 21 and the like.

In the above-discussed embodiment, the inner blade 21 includes a tetragonal cutout portion that forms the relief 25. However, as shown in FIG. 10(*a*), for example, the portion in the inner blade 21 that corresponds to the bend 11*b* of the outer blade may be beveled to form a relief 25*a*. Further, as shown in FIGS. 10(*b*) to 10(*d*), the portion of the inner blade 21 between the upper cutting edge 21*a* and side cutting edge 21*b* may be curved. In this case, the portion in the outer blade 11 between the upper wall 11*c* and the side wall 11*a* may form an orthogonal relief 11*h*, a trapezoidal relief 11*i*, or a thinned relief 11*j*. Alternatively, the inner blade 21 and the outer blade 11 may both include a relief.

In the above-discussed embodiment, the structure and shape of the inner blade 21 and outer blade 11 may be changed as required.

In the above-discussed embodiment, the outer blade 11 includes eight slits 11*d*. However, the outer blade 11 may include any other number of slits 11*d* although it is desirable that there be an even number of slits 11*d* to facilitate formation.

Although not particularly mentioned above, the battery may be a primary battery, such as a dry cell, or a rechargeable secondary battery.

The present examples and embodiments are to be considered as illustrative and not restrictive, and the invention is not to be limited to the details given herein, but may be modified within the scope and equivalence of the appended claims.

What is claimed is:

1. A hair remover comprising:

an outer blade;

a drive source; and an inner blade accommodated in the outer blade, the inner blade being rotatable by the drive source to clip body hair in cooperation with the outer blade;

the outer blade including:

a cylindrical side wall;

an upper wall;

a bend connecting the side wall and the upper wall; and straight upper cutting edges and straight side cutting edges formed by a plurality of slits extending from the upper wall to an upper part of the side wall; and the inner blade including a straight upper cutting edge, which is formed at a location corresponding to the upper cutting edges of the outer blade, a straight side cutting edge, which is formed at a location corresponding to the side cutting edges of the outer blade, and a relief that is formed so that the inner blade is free from a curved cutting edge at a location corresponding to the bend of the outer blade;

wherein the outer blade and the inner blade are formed so as to clip body hair through at least cooperation between the straight side cutting edges and cooperation between the straight upper cutting edges.

2. The hair remover according to claim 1, wherein the upper cutting edges of the outer blade and the inner blade each extend straight and perpendicular to a rotation axis of the inner blade.

3. The hair remover according to claim 1, wherein the outer blade includes an even number of the slits that are arranged at equal angular intervals.

4. The hair remover according to claim 3, wherein the outer blade includes eight of the slits.

5. The hair remover according to claim 1, wherein the upper cutting edge of the inner blade is discrete from the side cutting edge of the inner blade.

6. The hair remover according to claim 1, wherein the upper wall is flat;

the outer blade includes a plurality of teeth defined by the slits, each tooth including:

a basal portion extending upward substantially parallel to a center axis of the outer blade;

a distal portion extending inward toward the center axis of the outer blade; and a curved bent portion located between the basal portion and the distal portion; and wherein the upper cutting edges of the outer blade are formed on the distal portions of the teeth; and the side cutting edges of the outer blade are formed on the basal portions of the teeth.

7. The hair remover according to claim 6, wherein the relief formed at the location corresponding to the bend of the outer blade, is free from contact with the outer blade, and the inner blade is in contact with the outer blade only at straight portions including the upper cutting edge and the side cutting edge.

8. The hair remover according to claim 1, wherein the relief of the inner blade is a cutout portion configured not to clip body hair.

* * * * *